US005689859A

United States Patent [19]

Cuche

[11] Patent Number: 5,689,859

[45] Date of Patent: Nov. 25, 1997

[54] BRACELET CLASP WITH UNFOLDING BUCKLE

[75] Inventor: Cyril Cuche, Bienne, Switzerland

[73] Assignee: SMH Management Services AG, Biel, Switzerland

[21] Appl. No.: 663,927

[22] Filed: Jun. 14, 1996

[30] Foreign Application Priority Data

Jun. 15, 1995 [FR] France ..... 95 07145

[51] Int. Cl.[6] ..... A44B 11/00

[52] U.S. Cl. ..... 24/71 J; 24/69 J; 24/265 WS

[58] Field of Search ..... 24/71 J, 70 J, 24/69 J, 68 J, 265 WS

[56] References Cited

U.S. PATENT DOCUMENTS

| | | | |
|---|---|---|---|
| 1,741,421 | 12/1929 | Kraemer . | |
| 1,902,535 | 3/1933 | Andeson | 24/71 J |
| 3,863,299 | 2/1975 | Hocq | 24/71 J |
| 4,382,318 | 5/1983 | Takimoto | 24/71 J |

FOREIGN PATENT DOCUMENTS

| | | | |
|---|---|---|---|
| 353 567 | 4/1961 | Switzerland . | |
| 596 793 | 3/1978 | Switzerland . | |
| 641 332 | 2/1984 | Switzerland . | |
| 649 205 | 5/1985 | Switzerland . | |
| 665 101 | 4/1988 | Switzerland . | |
| 667 979 | 11/1988 | Switzerland . | |
| 671 499 | 9/1989 | Switzerland . | |
| 0659267 | 10/1951 | United Kingdom | 24/71 J |
| 1119101 | 7/1968 | United Kingdom | 24/71 J |

*Primary Examiner*—Victor N. Sakran

*Attorney, Agent, or Firm*—Griffin, Butler Whisenhunt & Kurtossy

[57] ABSTRACT

A bracelet clasp of the unfolding buckle type comprises a base plate (1) on which at least one hinged plate (2) is capable of being folded. A device enabling the two plates to be locked onto each other in a closed position comprises a first tongue (4) raised on the base plate (1) and a second tongue (5) raised on the hinged plate (2). In a closed position the two tongues are situated back to back and head to tail. The existence of a double tongue enables the locking force of one plate on the other to be doubled.

7 Claims, 3 Drawing Sheets

BRACELET CLASP WITH UNFOLDING BUCKLE

FIELD OF THE INVENTION

The present invention relates to a bracelet clasp of the type with an unfolding buckle comprising a base plate on which at least a first hinged plate is capable of being folded, said plates being attached to each other via one of their ends by means of a first hinge, these plates comprising a catch device enabling them to catch onto each other in a closed position.

BACKGROUND OF THE INVENTION

Holding two plates closed in a clasp with an unfolding buckle via a catch device is known. The document CH-A-353 567 shows a clasp comprising two metal plates connected by a hinge. One of these plates has a longitudinal slit and two studs and the other comprises an opening in which the studs can engage. Likewise, the document CH-A-671 499 describes two elements of an unfolding clasp, which are hinged together. One of the elements comprises an inserted and elastically deformable part made of a plastic material. This part engages in a rectangular opening arranged in the other element, with whose edges it co-operates in a frictional or catch engagement.

In both these examples and in all the others known to the applicant, there is a co-operation between an opening made in a first plate and a resilient element forming part of the second plate. These holding devices are satisfactory when they are new, but lose efficiency as they age. Wear of the opening is particularly noted. Indeed, the latter is not resilient and thus wears instead of bending or becoming deformed in a resilient manner. This results in a lack of reliability and, sooner or later, a lack of security as regards the closing of the bracelet.

SUMMARY OF THE INVENTION

In order to overcome this disadvantage, the present invention proposes to replace the opening made in one of the plates by a second resilient element co-operating with the first element situated on the other plate. Thus the catch device of the invention is characterised in that it comprises a first tongue emerging from the base plate and a second tongue emerging from the first hinged plate, said first and second tongues being back to back and head to tail in order to block said plates when they are in a closed position.

The invention will now be understood upon reading the description which is given below by way of example and illustrated by the drawings.

DETAILED DESCRIPTION OF THE DRAWINGS

Figure 1:
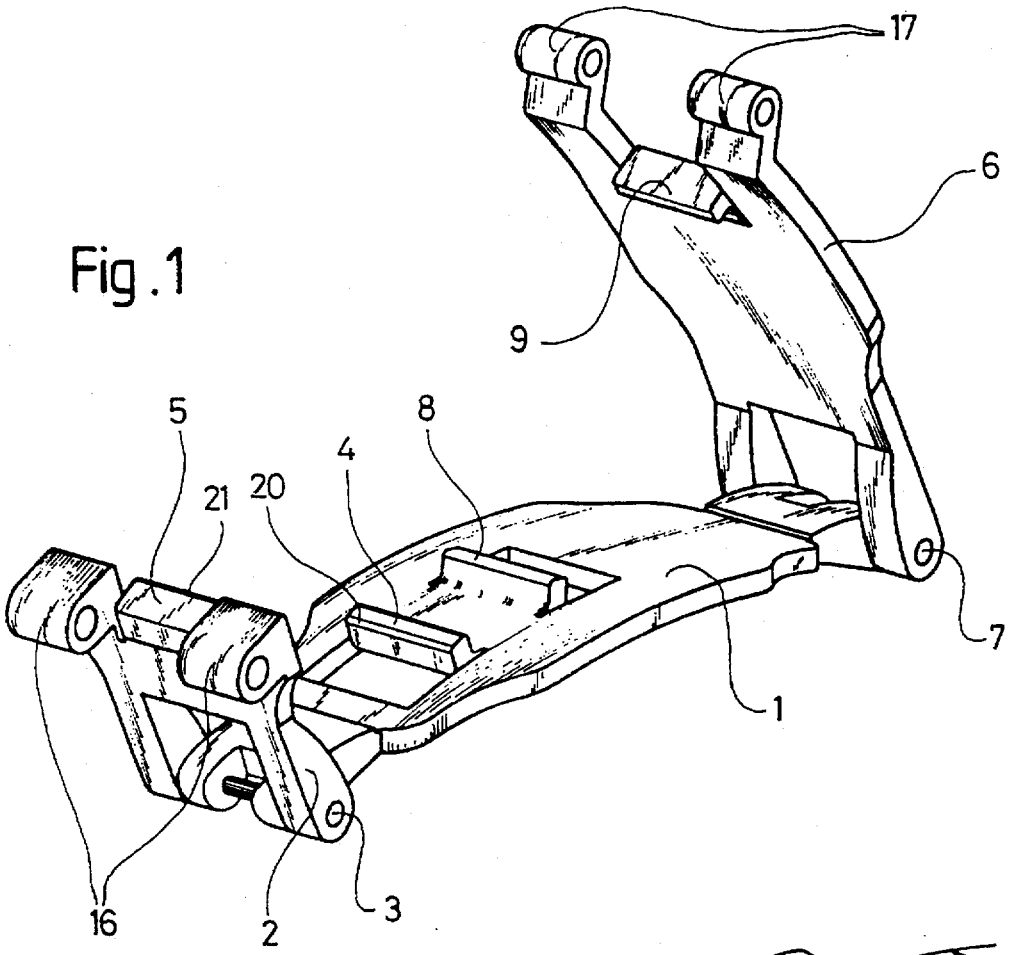
FIG. 1 is a perspective view of the clasp of the invention according to a first embodiment, the clasp being shown in an open position.
Figure 2:
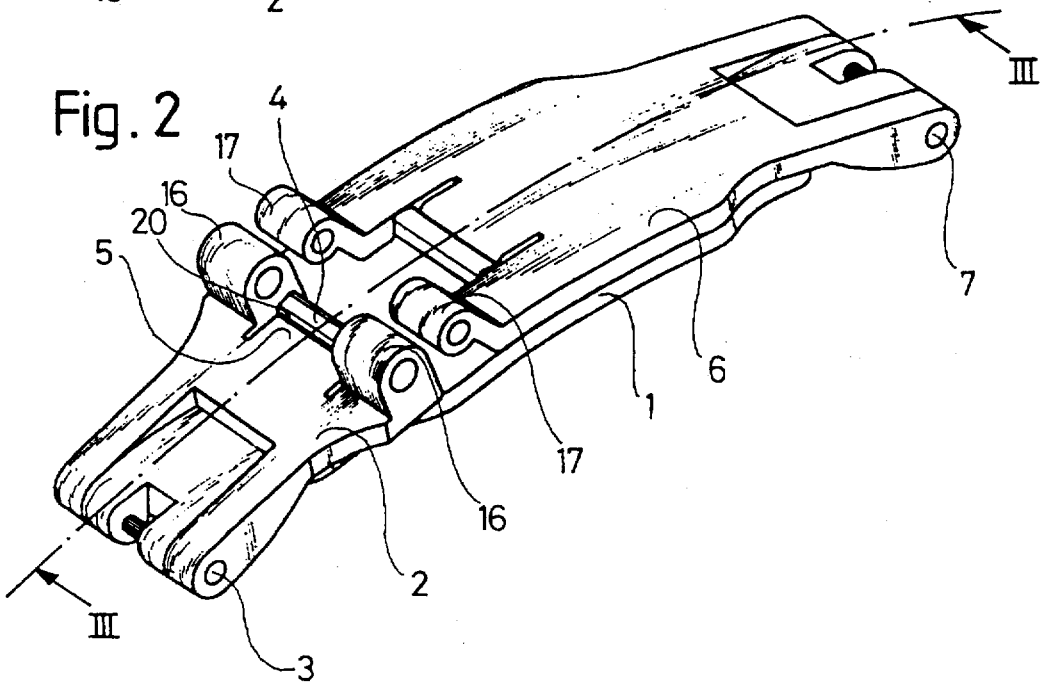
FIG. 2 is a perspective view of the clasp of FIG. 1, this clasp being shown in a closed position.
Figure 3:
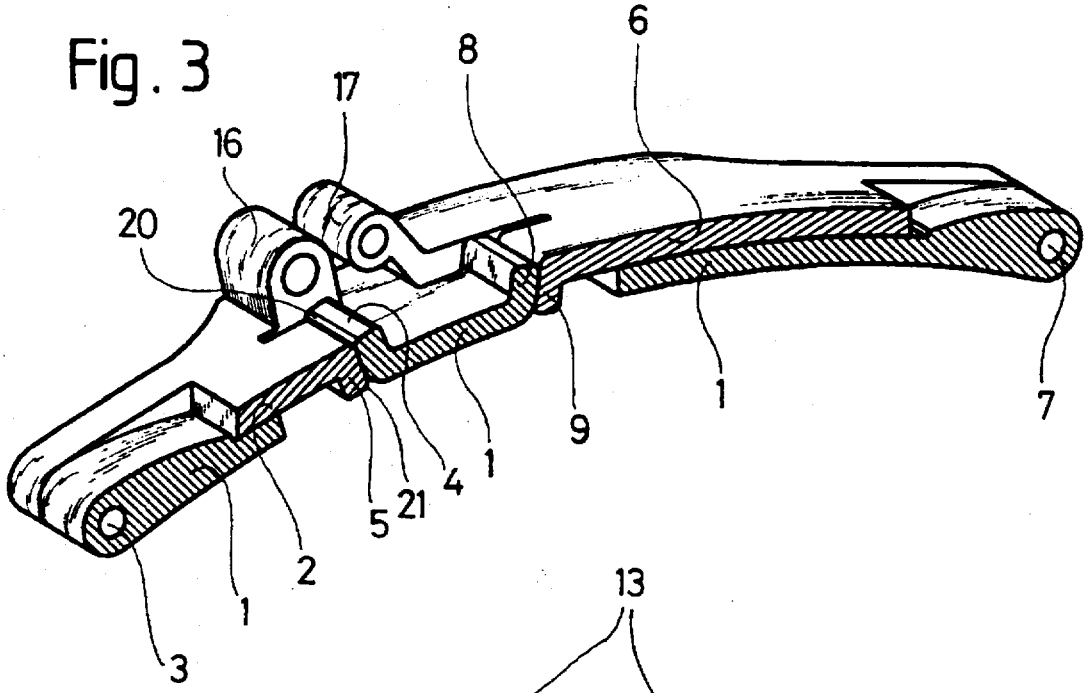
FIG. 3 is a perspective cross-sectional view of the clasp along the line III—III of FIG. 2.

Referring now to FIGS. 1 to 3, the clasp has, according to the first embodiment, a base plate 1 on which at least a first hinged plate 2 is capable of being folded. Plates 1 and 2 are attached to each other via one of their ends by means of a first hinge 3. These plates comprise a catch device which forms the principal object of the present invention and which enables them to catch onto each other in a closed position. This device will now be described in detail.

The catch device comprises a first tongue 4 which emerges from base plate 1 and a second tongue 5 which emerges from first hinged plate 2. As is seen clearly in FIG. 3, first and second tongues 4 and 5 are back to back and head to tail when the clasp is blocked in a closed position. As a matter of fact, one can see, in particular in FIG. 3, that the head of tongue 4 is contiguous with the root of tongue 5 and that, likewise, the head of tongue 5 is contiguous with the root of tongue 4, these tongues abutting against each other by their respective backs. Thus, in the catch system of the invention, it is not only one tongue which catches into an opening, as is the case of the clasps cited in the prior art documents, but two tongues which catch onto each other. The holding force of one plate on the other is thus multiplied by two. Indeed, tongues 4 and 5 each have a resilient effect, this effect is doubled at the moment when said tongues are applied back to back and head to tail against each other, i.e. when the plates are in a closed position.

FIGS. 1 to 3 also show that tongues 4 and 5 are each provided with a leading bevel referenced respectively 20 and 21. These bevels are arranged and sized to enable one tongue to slide smoothly onto the other at the moment of closing, which assures firstly a gradual locking movement, then a maximum tension in the closed position of the two plates. It will also be mentioned that plates 1 and 2 may, each and respectively, come from shaped strips which are cut to the desired width, which avoids costly machining operations. It will also be noted that first and second tongues 4 and 5 may be made integral with base plate 1 and first hinged plate 2, said tongues being raised on said materials. Cutting and stamping methods will be used for this.

In the event that the clasp of the invention has only one hinged plate 2 hinged on base plate 1, a first bracelet strand (not shown) would be attached to hinges 16 forming part of first hinged plate 2 and the second strand of the bracelet (not shown) would be attached to other hinges replacing hinge 7 which is situated on base plate 1. This simple embodiment is not shown in the drawings, but is very easily imaginable.

As is shown by FIGS. 1 to 3, the clasp may however have a second hinged plate 6 attached to base plate 1 by a second hinge 7. In this case the first bracelet strand (not shown) is attached to hinges 16 forming part of first hinged plate 2 and the second bracelet strand (also not shown) is attached to hinges 17 forming part of second hinged plate 6. In the case of the clasp having a base plate 1 and two hinged plates 2 and 6, two solutions may be envisaged for blocking second hinged plate 6 on base plate 1:

The first solution is illustrated by FIGS. 1 to 3. In these figures, the fastening device catching base plate 1 onto second hinged plate 6 is identical to that which has been described above. A third tongue 8 emerges from base plate 1 while a fourth tongue 9 emerges from second hinged plate 6. These third and fourth tongues 8 and 9 are back to back and head to tail to block said plates when they are in a closed position.

Figure 4:
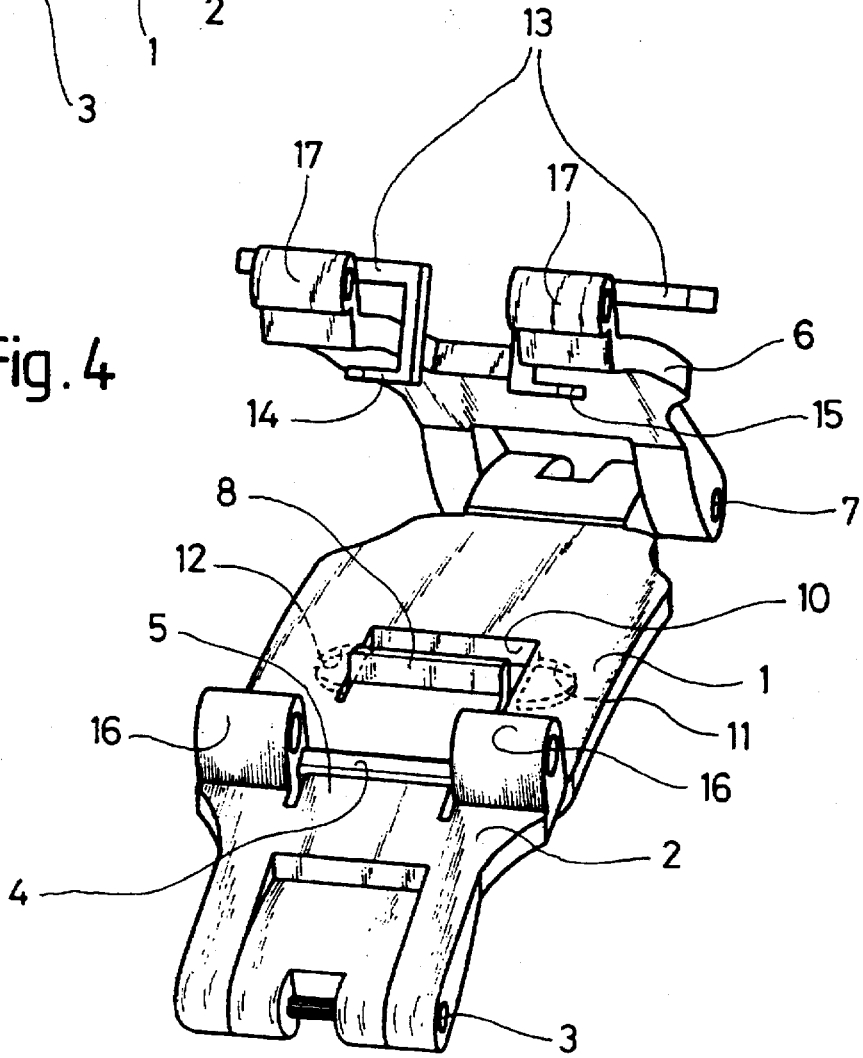
FIG. 4 is a perspective view of the clasp of the invention according to a second embodiment, the clasp being shown in one part in an open position and in another part in a closed postilion.
Figure 5:
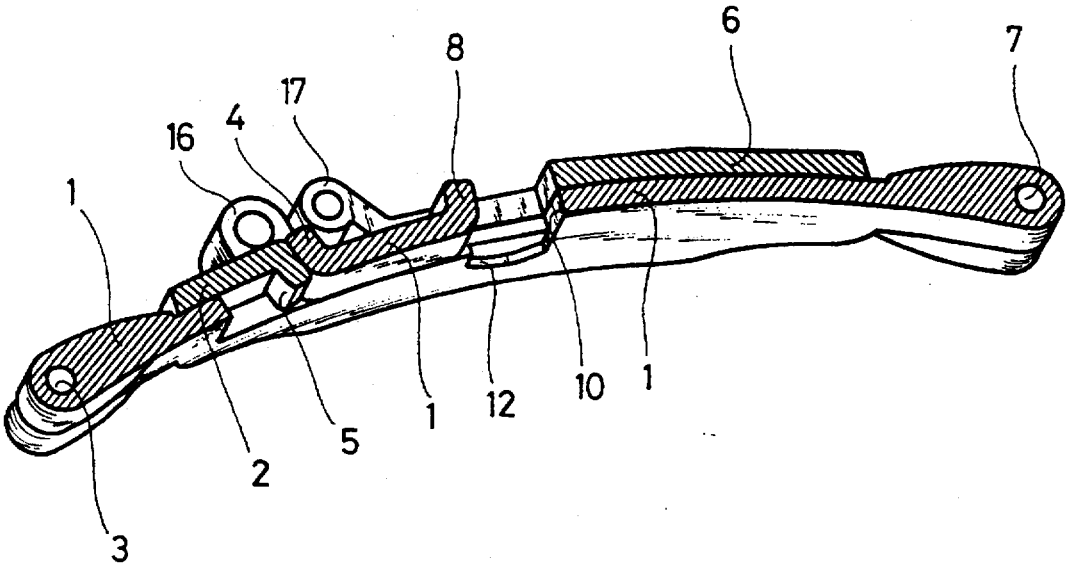
FIG. 5 is a longitudinal cross-section of the clasp of FIG. 4, this clasp being shown in a closed position.
Figure 6:
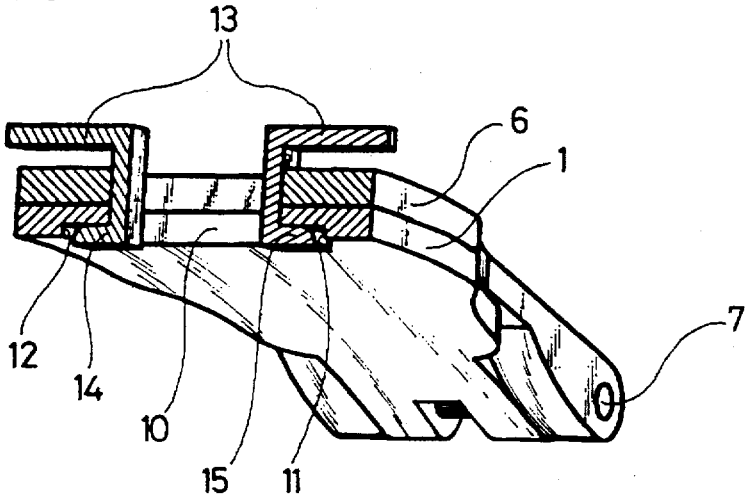
FIG. 6 is a transversal cross-section of a part of FIG. 4, this part being shown in a closed position.

The second solution is illustrated by FIGS. 4 to 6. As is seen in these figures, the fastening device catching base plate 1 onto second hinged plate 6 comprises an opening 10 made in base plate 1. On either side of said opening 10 and underneath the latter, are arranged recesses 11 and 12. Forming part of second hinged plate 6, as is shown in FIGS. 4 and 6, is a system of push-buttons 13 able to be actuated manually. These push-buttons are each provided with hooks 14 and 15 which engage in recesses 11 and 12 respectively, when plates 1 and 6 are in a closed position. This push-button and hook fastening system is known from the state of the art, and it has not therefore been illustrated and described in further detail here, but simply shown schematically. The interested reader will find a more complete description in the document CH-A-665 101. It is to be noted that, in order to better show opening 10 and recess 12 under said opening 10, FIG. 5 does not show the push-button mechanism.

FIGS. 4 to 6 also illustrate a second embodiment of the invention. One sees in these figures that base plate 1 comprises both a third tongue 8 which emerges from said base plate 1 and an opening 10 on either side and under which are arranged recesses 11 and 12. As a result of this arrangement, base plate 1 can receive either of two types of second hinged plate 6.

Second hinged plate 6 of the first type is described in relation to FIGS. 1 to 3 and comprises a fourth tongue 9 which emerges therefrom to co-operate with third tongue 8 of base plate 1, these tongues being back to back and head to tail in order to block plates 1 and 6 in a closed position.

Second hinged plate 6 of the second type has been described and illustrated in FIGS. 4 to 6. Second plate 6 comprises a push-button system 13 able to be actuated manually, these push-buttons being provided with hooks 14 and 15 which engage in the recesses respectively referenced 12 and 11 when plates 1 and 6 are in a closed position.

In conclusion of the foregoing, base plate 1, made according to FIGS. 4 to 6, is polyvalent in the sense that either a hinged plate equipped with a tongue, or a hinged plate equipped with push-buttons able to be actuated manually, can be mounted thereon.

What is claimed is:

1. A bracelet clasp with an unfolding buckle for receiving a first and a second bracelet strand, said clasp comprising a base plate on which at least a first hinged plate is capable of being folded, said base plate and said first hinged plate having first ends attached to each other by means of a first hinge and second ends connected to the first and second strands, respectively, said base plate and said first hinged plate comprising a catch device enabling them to catch onto each other in a closed position, said catch device comprising a first tongue emerging from the base plate and a second tongue emerging from the first hinged plate, said first and second tongues being back to back and head to tail when they are in said closed position in order to block the base plate and the first hinged plate in said closed position.

2. A bracelet clasp according to claim 1, wherein the first and second tongues are made of the same material as the base plate and the first hinged plate, respectively, and are integral with and raised from the material of the base plate and the first hinged plate, respectively.

3. A bracelet clasp according to claim 1, wherein the base plate and the first hinged plate are each respectively manufactured from shaped strips.

4. A bracelet clasp according to claim 1, comprising a second hinged plate attached to the base plate via a second hinge, the second hinged plate and the base plate being provided with a fastening device enabling the base plate and the second hinged plate to catch onto each other in a closed position.

5. A bracelet clasp according to claim 4, wherein the fastening device catching the base plate onto the second hinged plate comprises a third tongue emerging from the base plate and a fourth tongue emerging from the second hinged plate, said third and fourth tongues being back to back and head to tail in order to block the base plate and the second hinged plate when they are in a closed position.

6. A bracelet clasp according to claim 4, wherein the fastening device catching the base plate onto the second hinged plate comprises an opening in the base plate, on either side and under which are arranged recesses and a system of manually actuated push-buttons forming part of the second hinged plate, said push-buttons being provided with hooks engaging in said recesses when said base plate and second hinged plate are in a closed position.

7. A bracelet clasp according to claim 4, wherein the base plate comprises both a third tongue emerging from said base plate and an opening on either side of which and under which are arranged recesses, said base plate cooperating either and respectively with a fourth tongue emerging from the second hinged plate, said third and fourth tongues being back to back and head to tail in order to block said base plate and said second hinged plate when they are in a closed position, or with a system of manually actuated push-buttons forming part of the second hinged plate, push-buttons being provided with hooks engaging in said recesses when said base plate and said second hinged plate are in a closed position.

* * * * *